United States Patent [19]

Scherer

[11] Patent Number: 5,048,639

[45] Date of Patent: Sep. 17, 1991

[54] PORTABLE COOLER ASSEMBLY

[76] Inventor: Patrick Scherer, 39125 Ferris, Mount Clemens, Mich. 48043

[21] Appl. No.: 565,478

[22] Filed: Aug. 10, 1990

[51] Int. Cl.[5] ..... F25D 23/00; A47C 12/00

[52] U.S. Cl. ..... 182/18; 182/33; 182/129; 182/90; 62/457.7; 114/362

[58] Field of Search ..... 182/129, 20, 33, 18, 182/90; 62/457.7, 458, 258; 114/362

[56] References Cited

U.S. PATENT DOCUMENTS

| | | | |
|---|---|---|---|
| 1,635,183 | 7/1927 | Jeannotte | 182/129 |
| 2,658,640 | 11/1953 | Bayles | 182/129 |
| 3,482,418 | 4/1968 | Moore | 62/457 |
| 3,578,110 | 5/1971 | Seagraves | 182/129 |
| 4,581,902 | 4/1986 | Starck et al. | 62/258 |
| 4,950,033 | 8/1990 | Anderson | 182/33 |

*Primary Examiner*—Reinaldo P. Machado

*Attorney, Agent, or Firm*—Reising, Ethington, Barnard, Perry & Milton

[57] ABSTRACT

A portable cooler assembly (10) for use on a boat including an insulated container (12) for storing and insulating beverages including an insulated door (24) disposed in the container (12). The assembly (10) includes a plurality of steps (24) having two horizontal surfaces (30, 31) interconnected by a vertical riser (32). The door (24) is hinged (38) to the top horizontal surface (31) of the container (12) and pivots about an uppermost step (40) formed by the horizontal surface (31). The container (12) further comprises attachments (66) having a handle (68) to transport the assembly (10) and a dome shaped member (74) to receive the handle (68) and fixedly secure the assembly (10) to a lower surface (26).

30 Claims, 3 Drawing Sheets

PORTABLE COOLER ASSEMBLY

TECHNICAL FIELD

The subject invention relates generally to a portable cooler, and more specifically, to a portable cooler being further functional as a support of a load.

BACKGROUND ART

Portable coolers are commonly known for storing and insulating items of beverage, food, and the like, and to minimize the heat transfer between the contents within the cooler and the surrounding environment. Often, such coolers are also utilized as a seat or table top. Coolers are frequently used as part of the seat within a boat with the seat cushion removable to provide access to the contents within the cooler. However, such coolers are not adequately stable to support a load for use as a step to enter or exit the boat. Further, such coolers lack a plurality of steps required in loading of a larger depth boat.

The U.S. Pat. No. 4,581,902 to Stark et al, issued Apr. 15, 1986, discloses a portable cooler having an auxiliary table which is removable from the cooler container. Support legs extend between the container and the table for supporting the table at an elevated position above the container top and further allowing the container top to be opened independently of the table top. The support legs may further be contracted about the sides of the container so that the table top rests on the top surface of the container top and allows for convenient storage of the portable cooler.

The U.S. Pat. No. 3,482,418 to Moore, issued Dec. 9, 1969, discloses an insulated storage chest having an upper and lower compartment and means for draining fluid from the upper compartment to the lower compartment. The lower chest has a top lid hingedly secured thereto and the top chest, being of smaller dimensions than the top lid of the lower chest, is centered on and integral with the top lid of the lower chest. Therefore, the lid of the lower chest can only be lifted by pivoting the entire upper chest therewith.

The U.S. Pat. No. 3,578,110 to Seagraves, issued May 11, 1971, discloses a portable structure for use as a means to step into or out of a mobile home, or the like. The structure includes a plurality of treads interconnected by a plurality of vertical risers and front, back and side walls to form a generally box-like structure. The structure is further capable of being used as a storage means, with access being provided by one or more of the treads being adapted to be opened by hinges or the like and pivotal about one of the vertical risers.

It remains desirable, however, to provide a portable cooler assembly functional as an insulated container means for minimizing heat transfer to the surrounding environment, and further functional as a step to provide elevation between two surfaces.

SUMMARY OF THE INVENTION AND ADVANTAGES

In accordance with the present invention, there is provided a portable cooler assembly comprising an insulated container means for storing and insulating contents therein and for minimizing heat transfer between the contents and the surrounding environment. The assembly is characterized by the container means including step means for receiving a force thereon at an elevation between a lower surface and an upper surface.

The present invention is distinguishable over the prior art by providing an insulated container means which is further functional as a step by including at least one stepping surface to receive a force thereon and provide elevation between a lower surface and an upper surface, i.e., a step between the bottom and top of the cooler.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
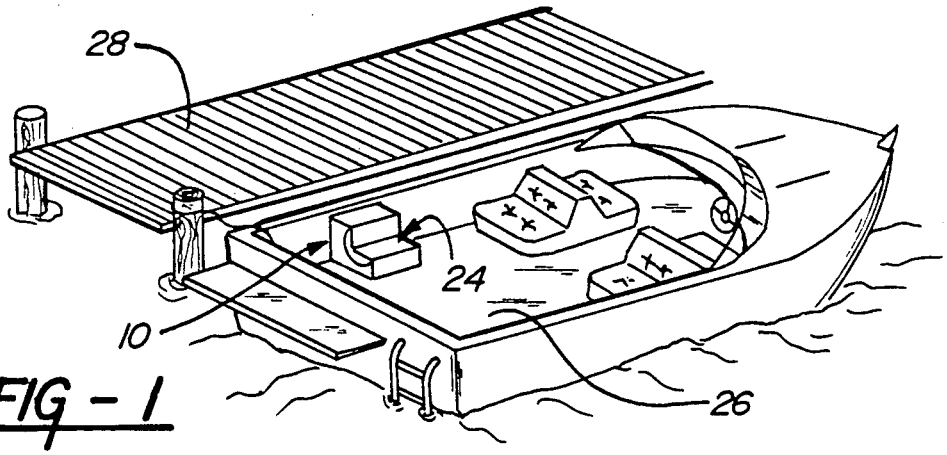
FIG. 1 is a perspective view of an assembly made in accordance with the present invention shown being used within a boat.

Referring to the Figures, wherein like numerals indicate like or corresponding parts throughout the several views, FIG. 1 shows a portable cooler assembly generally indicated at 10 positioned on the floor of a recreational boat. It will be appreciated that the portable cooler assembly 10 hereinafter described could be utilized in other environments and the recreational boating environment illustrated herein is used merely as means of description rather than of limitation. Accordingly, the assembly 10 includes an insulated container means 12 for storing and insulating contents therein, such as beverages and food, and for minimizing heat transfer between the contents and the surrounding environment. The container 12 may be made of sandwiched reinforced plastic layers for strength and thermal insulation properties. The container means 12 comprises a front wall 14, a back wall 16, a bottom surface 18, a pair of side walls 20, 21, and a top surface 22 interconnecting a portion of the side walls 20, 21 and the back wall 16.

The cooler assembly 10 is characterized by including step means, generally indicated at 24, for receiving a force thereon at an elevation between a lower surface 26 and an upper surface 28. As shown in FIG. 1, the lower surface 26 is shown as the boat floor and the upper surface 28 is shown as the rail or side of the boat or the dock adjacent the boat. The step means 24 comprises two generally horizontal surfaces 30, 31 spaced apart a predetermined vertical distance by a vertical riser 32. It will be appreciated that the step means 24 may include any number of horizontal surfaces 30, 31 and intermediate vertical risers 32. Thus, the assembly 10 and step means 24 can be adapted to a boat with a deeper hull which may require several levels of horizontal surfaces 30, 31 or steps 24 to reach the upper surface 28 or dock.

Figure 2:
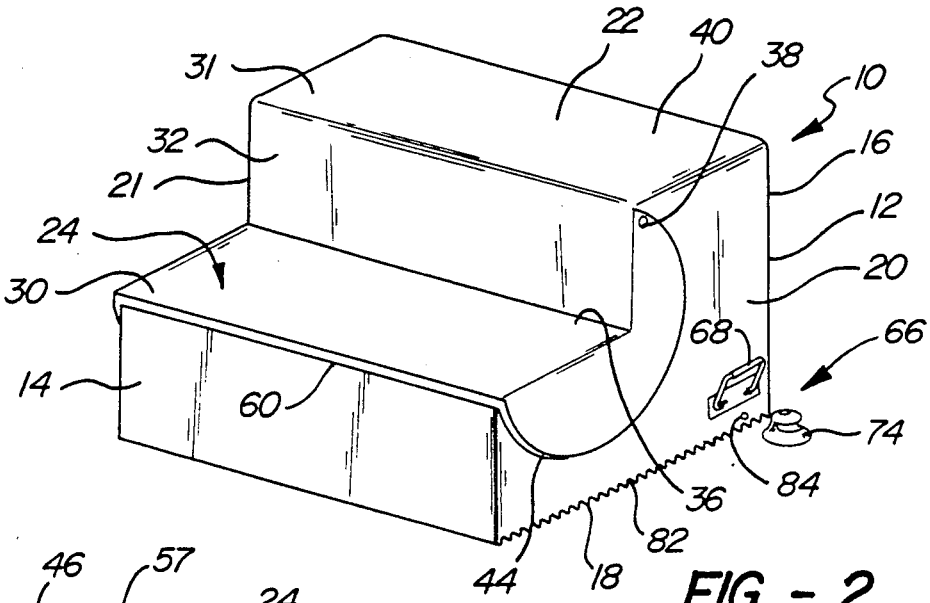
FIG. 2 is a perspective view of the assembly of FIG. 1 with the door means in a closed position.
Figure 3:
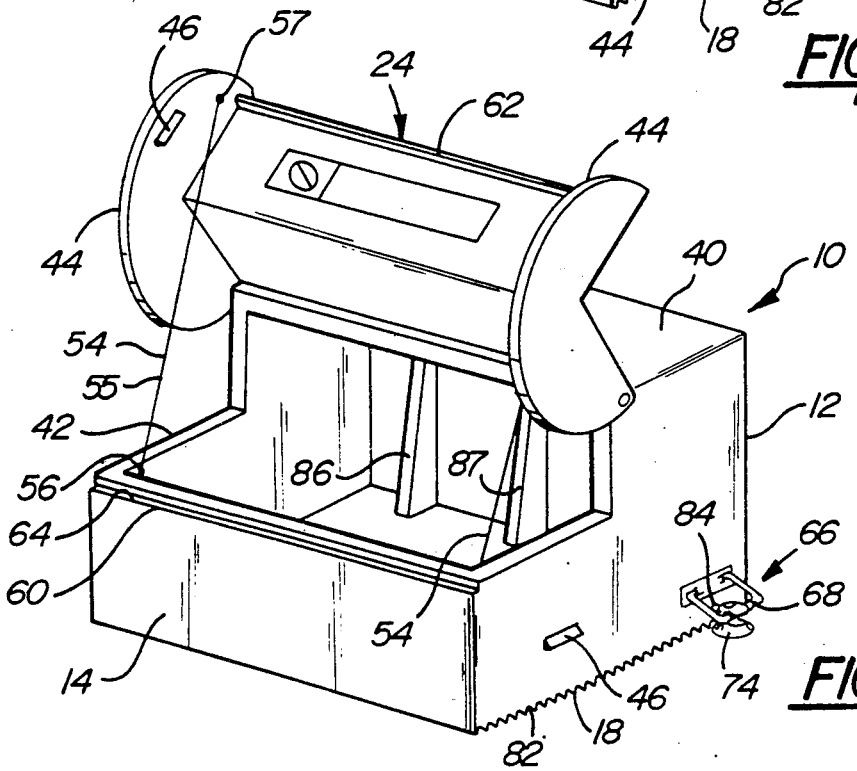
FIG. 3 is a perspective view of the assembly of FIG. 1 with the door means in an opened position.

The step means 24 also defines an insulated door means 24 for allowing access to the contents within the container means 12. As shown in FIGS. 2 and 3, the door means 24 defines the entire step means 24; however, the container 12 could include multiple risers 32 and steps 30, 31 with the door 24 defining only one step 30 and one riser 32 as shown or the door 24 could define multiple steps 30, 31 and risers 32, not shown. The door means 24 includes a horizontal stepping surface 30 of the surfaces 30, 31 and the vertical riser 32 to form an L-shaped portion 36 of the step means 24. The top surface 22 further defines an uppermost step 40 of the step means 24 most adjacent the upper surface 28 or dock. The door means 24 is further pivotally connected by a hinge 38 to the front edge of the uppermost step 40 and rotatable thereabout. Alternatively, the door means 24 may be pivotally connected by the hinge 38 to the side walls 20, 21 and rotatable about the top surface 22 which forms the uppermost step 40. In the complimentary fashion, the container means 12 includes an L-shaped opening 42 extending between the front wall 14 and the uppermost step 40. The L-shaped opening 42 is closed by the L-shaped portion 36 of the step means 24 defining the door means 24.

It will be appreciated that the door means 24 may include any combination of horizontal surfaces 30, 31 and intermediate vertical risers 32 and be pivotal about any of the horizontal surfaces 30, 31 which may or may not include the uppermost step 40.

Figure 6:
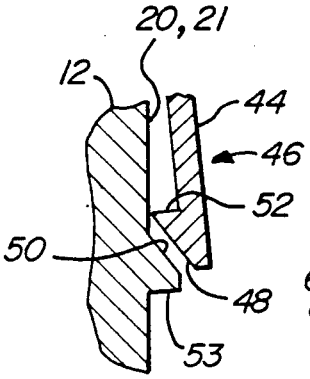
FIG. 6 is an enlarged fragmentary cross-sectional view taken substantially along lines 6—6 of FIG. 5.
Figure 5:
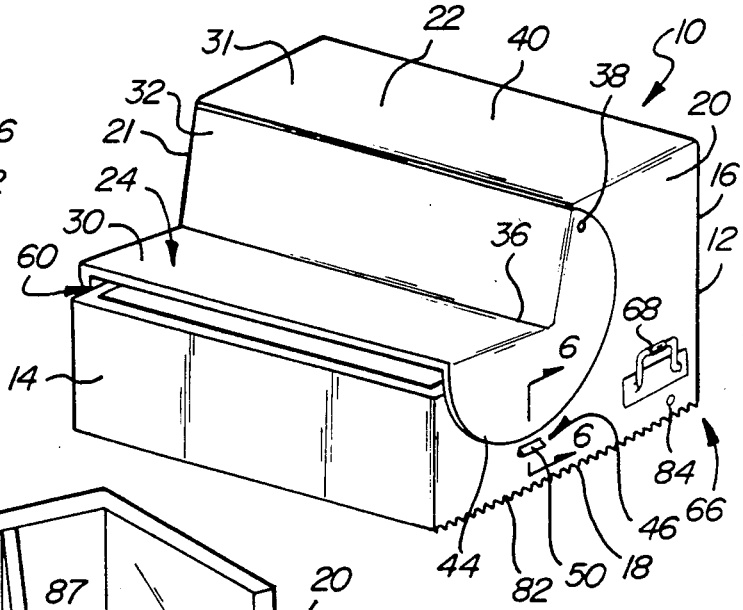
FIG. 5 is a perspective view of the assembly of FIG. 2 with the door means in a partially opened position.

The door means 24 further includes stabilizer means 44 to provide lateral strength to the door means 24 upon pivotal movement about the uppermost step 40. The stabilizer means 44 is generally arcuate in shape and extends outwardly and downwardly from the horizontal 30 and vertical 32 surfaces on opposite sides of the door means 24. The stabilizer means 44 extend from the door means 24, such that, upon closing the door means 24 over the L-shaped opening 42, the stabilizer means 44 overlay each of the side walls 20, 21. As shown in FIG. 5, the stabilizer means 44 includes a latch means 46 for fastening the door means 24 to the container means 12. As shown in FIG. 6, the latch means 46 includes a first camming surface 48 which is fixedly secured to the intersurface of the stabilizer means 44 on each side of the door means 24 and a second camming surface 50 fixedly secured to each of the side walls 20, 21. In operation, upon positioning the door means 24 in the closed position, the first camming surface 48 engages with the second camming surface 50 and is guided therealong. Each camming surface 48, 50 further includes a lip 52, 53, such that, when the door means 24 is fully in the closed position, the first camming surface 48 is fully extended over the second camming surface 50 and the lips 52, 53 engage one another to secure the door means 24 to the container means 12. It is also noted in FIG. 5 that when the door means 24 is in the closed position, the camming surfaces 48, 50 of latch means 46 are parallel to the bottom surface 18 along a longitudinal axis which extends between the front wall 14 and the back wall 16. To release the latch means 46, the user extends the stabilizer means 44 away from the side walls 20, 21 of the container means 12 to disengage the lips 52, 53 of the camming surfaces 48, 50. The door means 24 is then free to rotate about the uppermost step 40 to a fully opened position as shown in FIG. 3.

The door means 24 further includes a restraint means 54 to prevent the door means 24 from remaining open without support. As shown in FIG. 3, the restraint means 54 includes a string, line, or the like 55, fixedly secured at one end 56 to the side wall 20, 21 and fixedly secured at the other end 57 to the stabilizer means 44. Thus, upon opening the door means 24, the restraint means 54 prevents opening the door means 24 past a vertical position and thus, the door means 24 will not remain open without the support by the cooler assembly user.

The door means 24 further includes seal means 60, as shown in FIG. 3, disposed between the horizontal stepping surface 30 and the front wall 14 for preventing heat transfer therebetween. The seal means 60 includes a flange 62 extending outwardly and downwardly from the horizontal surface 30 of the door means 24 and extending to each of the stabilizer means 44. The seal means 60 further includes a groove 64 formed in the top surface of the front wall 14 and extending to each of the side walls 20, 21. The flange 62 is received in the groove 64 to provide an overlapping seal and minimize heat transfer from the container means 12.

Figure 4:
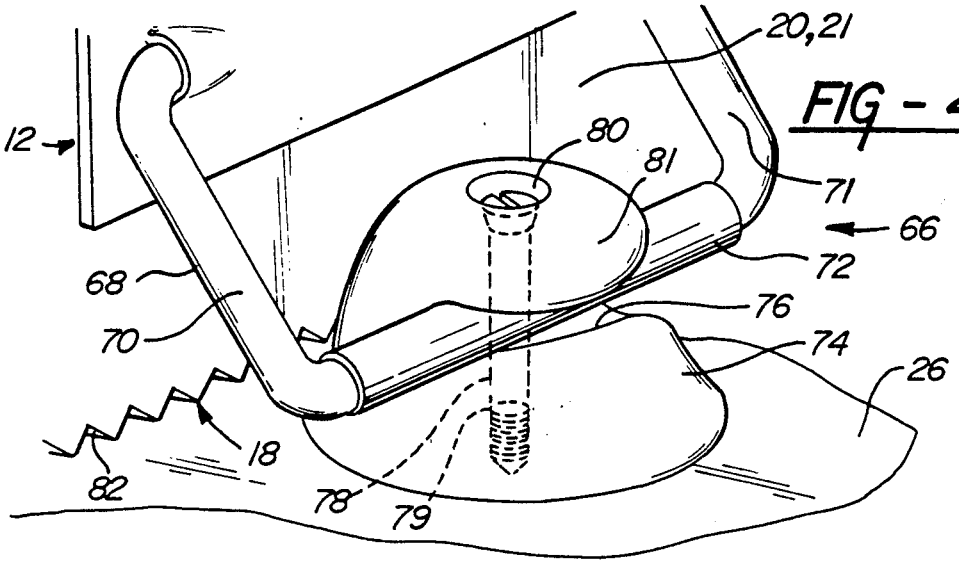
FIG. 4 is an enlarged fragmentary perspective view of the attachment means of FIG. 3.

The cooler assembly 10 further comprises attachment means 66 for securing the assembly 10 to the lower surface 26. As shown in FIG. 4, the attachment means 66 includes a semi-flexible handle 68 pivotally connected to each of the side walls 20, 21 at a position adjacent the bottom surface 18. Each handle 68 includes two arms 70, 71 extending outwardly from the side walls 20, 21 and a cross bar 72 interconnecting the arms 70, 71. The attachment means 66 further includes a rigid dome shaped member 74 which is fixedly secured to the lower surface 26, or boat floor as shown in FIG. 1. The dome shaped member 74 includes a receiving slot 76 formed therein and extending halfway about the circumference of the dome shaped member 74. The dome shaped member 74 further includes a fastener 78 passing through and inset 80 in a center bore 79 of the member 74 to secure the member 74 to the lower surface 26. Upon attachment, the handle 68 is pivoted about the dome shaped member 74 and the handle 68 stretched about an upper portion 81 of the dome shaped member 74 until received in the receiving slot 76 and lockably engaged therein. The handles 68 are formed of a semi-flexible material such as nylon, or the like, such that, the handles 68 may be stretched by the user about the upper portion 81 of the dome shaped member 74 and positioned in the receiving slot 76 with tension biased the center of the member 74. To release the attachment means 66, the user pulls the semi-flexible handle 68 out of the slot 76 and over the upper portion 81 of the member 74. The assembly 10 is then further capable of being transport by support of the handles 68. It will be appreciated that the attachment means 66 may alternatively include a rigid handle 68 which may press about an upper flexible portion 81 of a flexible dome shaped member 74 until received in the slot 76 and locked therein.

The container means 12 further comprises a plurality of passageways 82 formed in the bottom surface 18 and forming a serrated-type bottom surface 18 for allowing fluid to pass laterally beneath the container means 12. The passageways 82 extend between each of the side walls 20, 21 and are of uniform dimensions. Thus, as fluid such as water collects on the lower surface 26 or boat floor, the fluid is free to pass beneath the container means 12 and assembly 10. The container means 12 further includes a drainage hole 84 in one of the side walls 20, 21 adjacent the bottom surface 18. The drainage hole 84 may be positioned immediately above one of the passageways 88 so that upon drainage of fluid from the container means 12 the fluid may immediately access one of the passageways 82 to drain beneath the bottom surface 18 of the container means 12.

Figure 7:
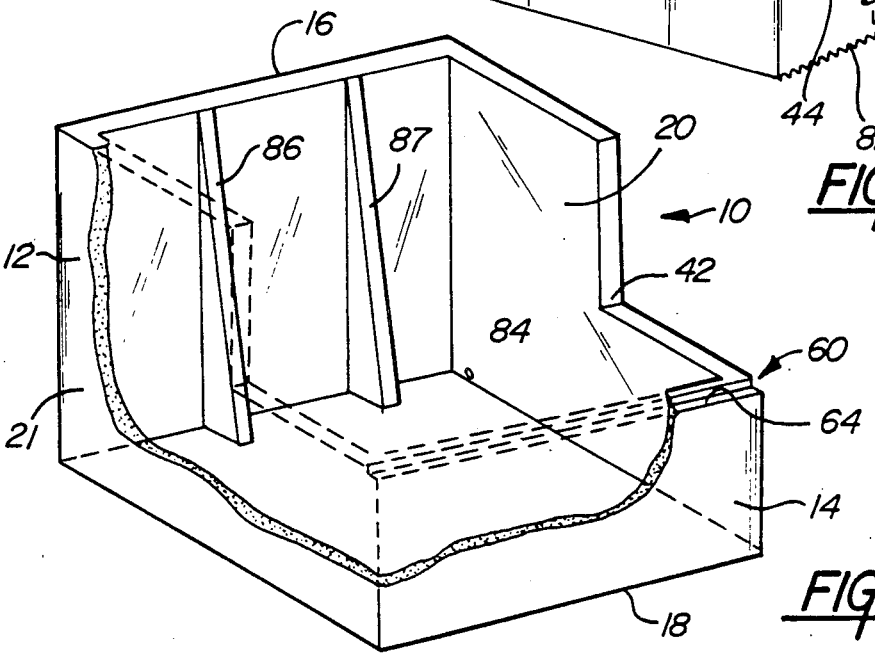
FIG. 7 is a partially broken away perspective view of the container means of FIG. 1.

The cooler assembly 10 further comprises support means 86, 87 to provide addition support to the step means 24 and container means 12 when a force is applied thereto. The support means 86, 87, as best shown in FIG. 7, are secured to the backwall 16 and are generally triangular in shape and extend from the uppermost step 40 to the bottom surface 18 within the container means 12. It will be appreciated that the support means 86,87 may likewise be provided by the reinforced walls 14,16,20,21 or any suitable manner which provides support and enables a force to be received on the step means 24.

Figure 8:
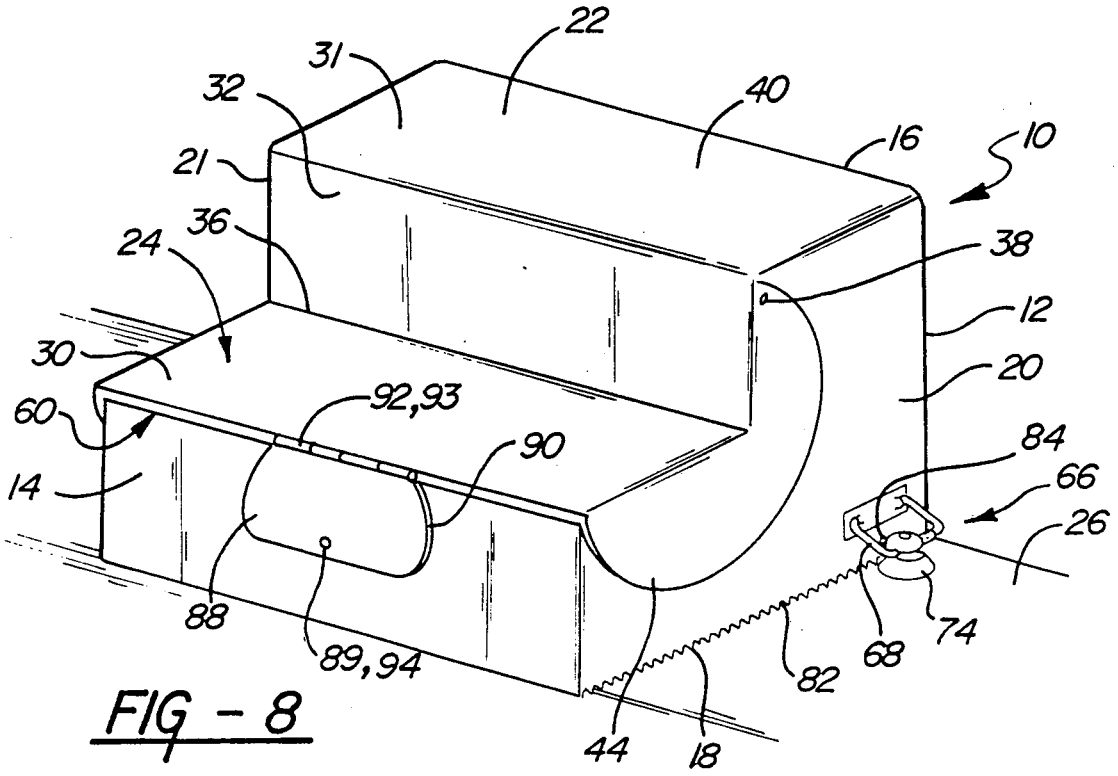
FIG. 8 is a perspective view of the assembly of FIG. 2 with the safety device in a closed position and the step means accessible.
Figure 9:
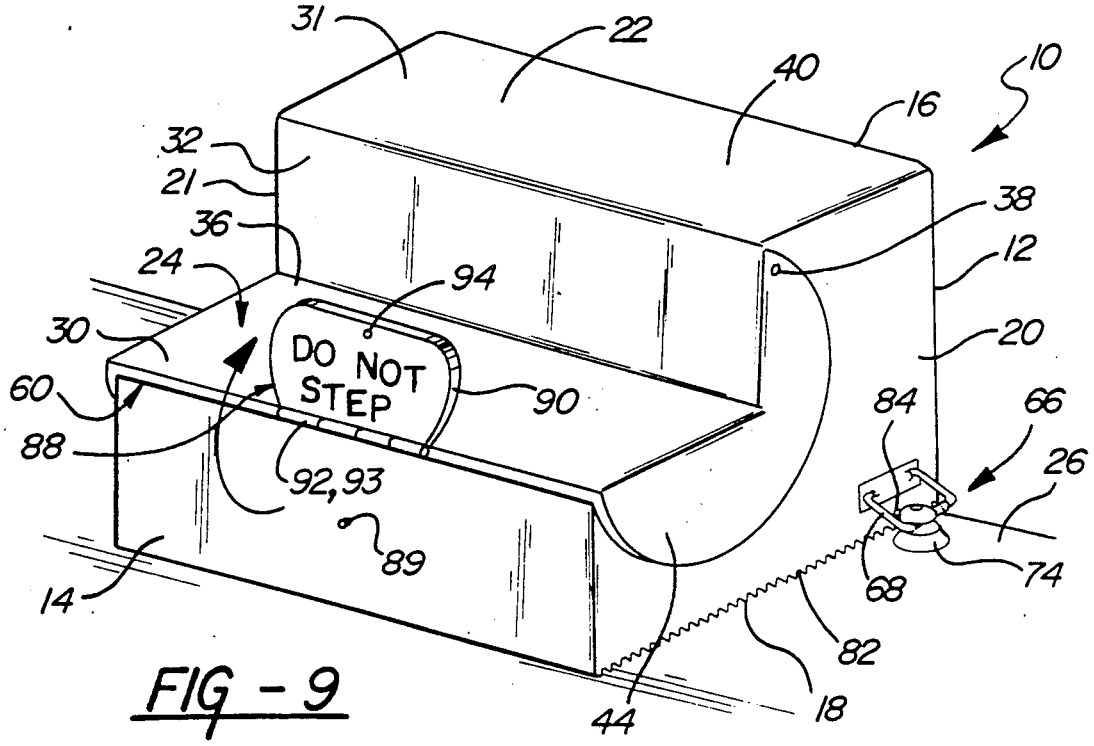
FIG. 9 is a perspective view of the assembly of FIG. 2 with the safety device in an active or opened position and the step means unaccessible.

As a means of caution, the cooler assembly 10 includes a safety device 88, as shown in FIGS. 9 and 10, for cautioning the user against using the step means 24 when the door means 24 is not in the closed position. The safety device 88 includes a generally circular flap 90 connected by a hinge 92 to the front edge of the horizontal stepping surface 30 of the door means 24 and pivotal thereabout. The safety device 88 further includes a lock 89 extending outwardly from the front wall 14 and received within an aperture 94 in the circular flap 90 for lockably engaging the safety device 88 to the front wall 14 of the container means 12. In operation, the hinge includes a spring 93 which is in tension when the safety device 88 is in an inoperative or closed position of overlaying the front wall 14 and engaged by the lock as shown in FIG. 8. In other words, the spring 93 is upwardly bias to cause the device 88 to extend to an active position as shown in FIG. 9. When the lock 89 is released, the spring extends the circular flap of the safety device to its operative or active position which is perpendicular to and extending upwardly from the horizontal stepping surface 30. Therefore, when the safety device 88 is in the operative position it will prevent the user from being able to access the step means 24 of the assembly 10. Furthermore, the user can not open the door means 24 to access the contents within the container means 12 unless the safety device 88 is unlocked and in the active position as shown in FIG. 9.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A portable cooler assembly (10) comprising: insulated container means (12) for storing and insulating contents therein and for minimizing heat transfer between the contents and the surrounding environment; said assembly characterized by said container means (12) including step means (24) for receiving a force thereon at an elevation between a lower surface (26) and an upper surface (28).

2. An assembly (10) as set forth in claim 1 further characterized by said step means (24) including at least two generally horizontal surfaces (30, 31) spaced apart a predetermined vertical distance (32).

3. An assembly (10) as set forth in claim 2 further characterized by said step means (24) having at least one riser (32) interconnecting said horizontal surfaces (30, 31).

4. An assembly (10) as set forth in claim 3 further characterized by including door means (24) disposed in said container means (12) for allowing access to the contents within said container means (12).

5. An assembly (10) as set forth in claim 4 further characterized by said door means (24) being insulated.

6. An assembly (10) as set forth in claim 5 further characterized by said door means (24) defining said step means (24).

7. An assembly (10) as set forth in claim 6 further characterized by said door means (24) including at least one of said horizontal surfaces (30, 31) and at least one of said risers (32).

8. An assembly (10) as set forth in claim 7 further characterized by said container means (12) including a front wall (14), a back wall (16), a bottom surface (18), a pair of side walls (20, 21), and a top surface (22) interconnecting a portion of said side walls (20, 21) and said back wall (16) and forming an uppermost step (40) of said step means (24).

9. An assembly (10) as set forth in claim 8 further characterized by said door means (24) extending between said front wall (14) and said uppermost step (40) of said container means (12).

10. An assembly (10) as set forth in claim 9 further characterized by said door means (24) being hinged (38) to the front edge of said uppermost step (40) and rotational about said uppermost step (40).

11. An assembly (10) as set forth in claim 10 further characterized by said door means (24) including a horizontal stepping surface (30, 31) and a vertical riser (32) forming an L-shaped step portion (36) of said step means (24).

12. An assembly (10) as set forth in claim 11 further characterized by said container means (12) further including an L-shaped opening (42) extending between said front wall (14) and said uppermost step (40) and closed by said door means (24).

13. An assembly (10) as set forth in claim 12 further characterized by said door means (24) including stabilizer means (44) to provide lateral strength to said door means (24) upon pivotal movement about said uppermost step (40).

14. An assembly (10) as set forth in claim 13 further characterized by said stabilizer means (44) being generally arcuate in shape and extending outwardly from said horizontal (30, 31) and vertical surfaces (32) on each side of said door means (24) and overlaying said side walls (20, 21) when said door means (24) is in a closed position and concealing said opening (42).

15. An assembly (10) as set forth in claim 14 further characterized by said assembly (10) including latch means (46) for fastening said door means (24) to said container means (12).

16. An assembly (10) as set forth in claim 15 further characterized by said latch means (46) including a first camming surface (48) fixedly secured to the inner surface of each of said stabilizer means (44) and a second camming surface (50) fixedly secured to each of said side walls (20, 21) and said first (48) and second (50) camming surfaces being parallel to said bottom surface (18) along a longitudinal axis extending between said front wall (14) and said back wall (16) when said door means (24) is in said closed position.

17. An assembly (10) as set forth in claim 16 further characterized by said door means (24) including restraint means (54) to prevent said door means (24) from remaining open without support.

18. An assembly (10) as set forth in claim 17 further characterized by said restraint means (54) being fixedly secured to and extending from each of said side walls (20, 21) at a position adjacent said front wall (14) to said stabilizer means (44) at a position adjacent said horizontal surface (30).

19. An assembly (10) as set forth in claim 18 further characterized by said door means (24) including seal means (60) disposed between said horizontal stepping surface (30) and said front wall (14) for preventing heat transfer therebetween.

20. An assembly (10) as set forth in claim 19 further characterized by said seal means (60) including a flange (62) extending outwardly from said horizontal surface (30) of said door means (24) extending to each of said stabilizer means (44) and received in a groove (64) formed in said front wall (14) extending to each of said side walls (20, 21).

21. An assembly (10) as set forth in claim 20 further characterized by said assembly (10) including attachment means (66) for securing said assembly (10) to the lower surface (26).

22. An assembly (10) as set forth in claim 21 further characterized by said attachment means (66) including at least one handle (68) pivotally connected to one of said side walls (20, 21) adjacent said bottom surface (18) and a dome shaped member (74) for being fixedly secured to the lower surface (26) adjacent said side wall (20, 21) and having a receiving slot (76) formed therein for receiving said handle (68) and lockably securing said assembly to the lower surface (26).

23. An assembly (10) as set forth in claim 22 further characterized by said dome shaped member (74) including a fastener (78) passing through and inset (80) in the center (79) of said dome shaped member (74) to secure said dome shaped member (74) to the lower surface (26).

24. An assembly (10) as set forth in claim 23 further characterized by said bottom surface (18) having a plurality of passageways (82) extending to each of said side walls (20, 21) forming a serrated surface for allowing fluid to pass laterally beneath said container means (12).

25. An assembly (10) as set forth in claim 24 further characterized by said container means (12) including a drainage hole (84) in one of said side walls (20, 21) adjacent said bottom surface (18) and positioned immediately above one of said passageways (82) to drain fluid from said container means (12).

26. An assembly (10) as set forth in claim 25 further characterized by said container means (12) including support means (86,87) adapted within said container means (12) to provide support when a force is applied to said step means (24).

27. An assembly (10) as set forth in claim 26 further characterized by said assembly (10) including a safety device (88) for cautioning the user against using the step means (24) when said door means (34) is out of said closed position.

28. An assembly (10) as set forth in claim 27 further characterized by said safety device (88) including a general circular flap (90) connected by a hinge (92) to said horizontal stepping surface (30) of said door means (24) and pivotal about said stepping surface (30).

29. An assembly (10) as set forth in claim 28 further characterized by said hinge (92) being spring loaded and said spring (93) being in tension when said safety device (88) is in an inoperative position by overlaying said front wall (14) of said container means (12) and said spring (93) being out of tension when said safety device (88) is in an operative position of being perpendicular to and extending upwardly from said horizontal stepping surface (30).

30. An assembly (10) as set forth in claim 29 further characterized by said safety device (80) further including a lock (89) connected to said front wall (14) to lockable engage said safety device (88) when in said inoperative position.

* * * * *